US005161868A

United States Patent [19]

Hooser

[11] Patent Number: 5,161,868

[45] Date of Patent: Nov. 10, 1992

[54] TELEPHONE TABLE

[76] Inventor: Herbert M. Hooser, Asuka Apt., Suite #201, 16 Daikyo-cho, Shinjuku, Tokyo 160, Japan

[21] Appl. No.: 765,314

[22] Filed: Sep. 25, 1991

[51] Int. Cl.[5] ..... A47B 77/08

[52] U.S. Cl. ..... 312/223.4; 312/312

[58] Field of Search ..... 108/147, 25, 50; 312/312, 223

[56] References Cited

U.S. PATENT DOCUMENTS

| | | | |
|---|---|---|---|
| D. 144,859 | 5/1946 | McKenzie | 108/25 X |
| 2,456,429 | 12/1948 | Parsons | 312/312 |
| 3,140,559 | 7/1967 | Grow et al. | 108/147 |
| 3,208,409 | 9/1965 | Gale | 108/25 |
| 3,244,125 | 4/1966 | Mackey | 108/25 |

*Primary Examiner*—Joseph Falk

*Attorney, Agent, or Firm*—Richard L. Miller

[57] ABSTRACT

A telephone table is provided which consists of a lower cabinet for holding various components therein, which are used in conjunction with a telephone. A storage door has a plurality of internal shelves attached thereto, while the storage door is hinged to the lower cabinet. A plurality of locking casters are mounted to the underside of the lower cabinet so that the lower cabinet can be rolled along a floor and retained in a stationary position. An upper table top has receptacles for holding a pen, a pencil and note paper. A pull our side board is in the upper table top for holding writing paper and the like. A rest plate is carried on the upper table top, whereby the rest plate will secure the base of the telephone thereto, so that a person using the telephone does not have to hold onto the base of the telephone. A mechanism is for varying the height and tilting of the upper table top with respect to the lower cabinet, so that the person can stand, sit and recline proximate the telephone table when using the telephone.

3 Claims, 2 Drawing Sheets

TELEPHONE TABLE

BACKGROUND OF THE INVENTION

The instant invention relates generally to attachments for telephones and more specifically it relates to a telephone table.

Numerous attachments for telephones have been provided in the prior art that are adapted to each mount the base of a telephone received thereto, so that the telephone can be used therefrom. For example, U.S. Pat. No. 2,414,110 to Lee et al.; U.S. Pat. No. 2,610,867 to Hamilton and U.S. Pat. No. 2,667,367 to Lapinski et al all are illustrative of such prior art. While these units may be suitable for the particular purpose to which they address, they would not be as suitable for the purpose of the present invention as hereafter described.

SUMMARY OF THE INVENTION

A primary object of the present invention is to provide a telephone table that will overcome the shortcomings of the prior art devices.

Another object is to provide a telephone table that contains a built-in telephone rest plate for securing a telephone base thereto, so that a person using the telephone will not have to hold onto the base.

An additional object is to provide a telephone table in which an upper table top having the telephone rest plate can be height adjustable with respect to a lower cabinet, so that the person using the telephone can stand, sit or recline next to the telephone table.

A further object is to provide a telephone table that is simple and easy to use.

A still further object is to provide a telephone table that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

Figure 5:
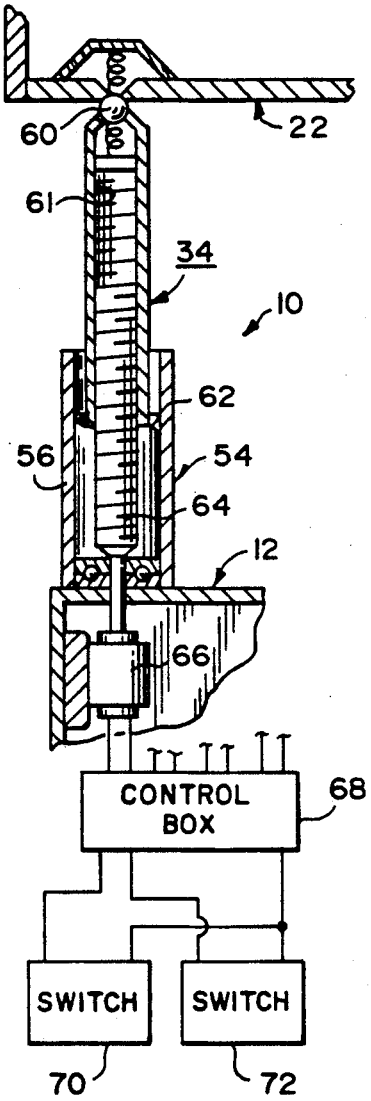
Figure 7:
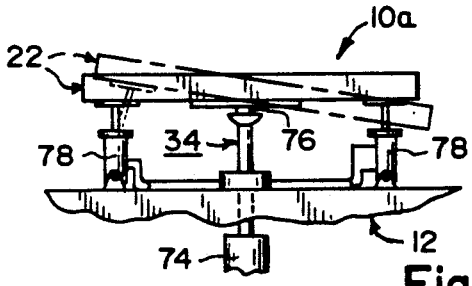
Figure 6:
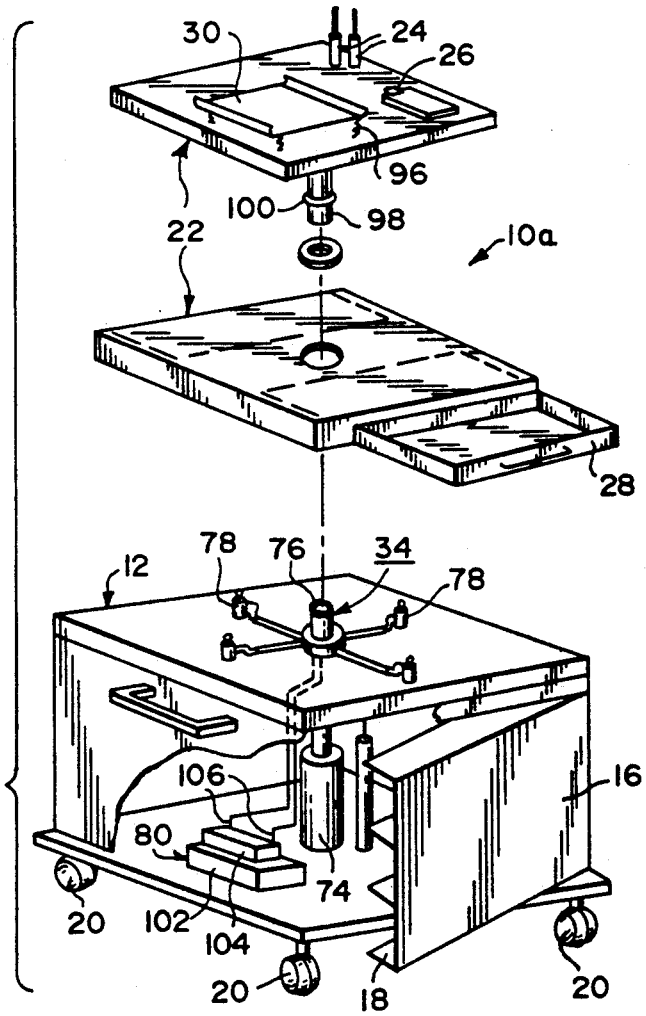

FIG. 5 a diagrammatic cross sectional view of the elevation mechanism showing the construction thereof in greater detail;

FIG. 6 is a fragmentary diagrammatic exploded perspective view o form of the invention; and FIG. 7 is a diagrammatic fragmentary side elevational view of the upper portion of the modified form shown in FIG. 6.

DETAILED DESCRIPTION OF THE PREFERRED EMBODIMENTS

Turning now descriptively to the drawings, in which similar reference characters denote similar elements throughout the several views, the Figures illustrate a telephone table 10 which consists of a lower cabinet 12 for holding various components therein, which are used in conjunction with a telephone 14. A storage door 16 has a plurality of internal shelves 18 attached thereto, while the storage door 16 is hinged to the lower cabinet 12. A plurality of locking casters 20 are mounted to the underside of the lower cabinet 12, so that the lower cabinet 12 can be rolled along a floor and retained in a stationary position. An upper table top 22 has receptacles 24 and 26 for holding a pen, a pencil and note paper. A pull out side board 28 is in the upper table top 22 for holding writing paper and the like. A rest plate 30 is carried on the upper table top 22, whereby the rest plate 30 will secure the base 32 of the telephone 14 thereto, so that a person using the telephone 14 does not have to hold onto the base 32 of the telephone 14. A mechanism 34 is for varying the height and tilting of the upper table top 22 with respect to the lower cabinet, so that the person can stand, sit and recline proximate the telephone table 10 when using the telephone 14.

Figure 2:
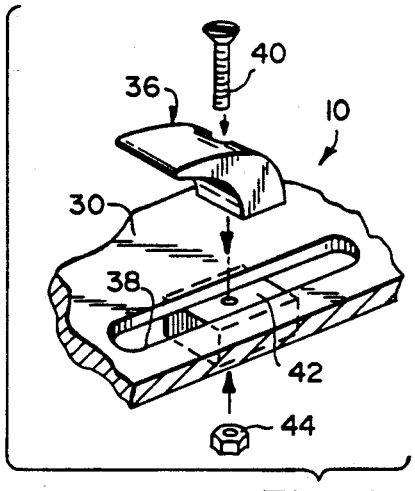
FIG. 2 is an enlarged fragmentary partially exploded view of the telephone base rest plate removed therefrom, showing one of the clamps in greater detail.
Figure 3:
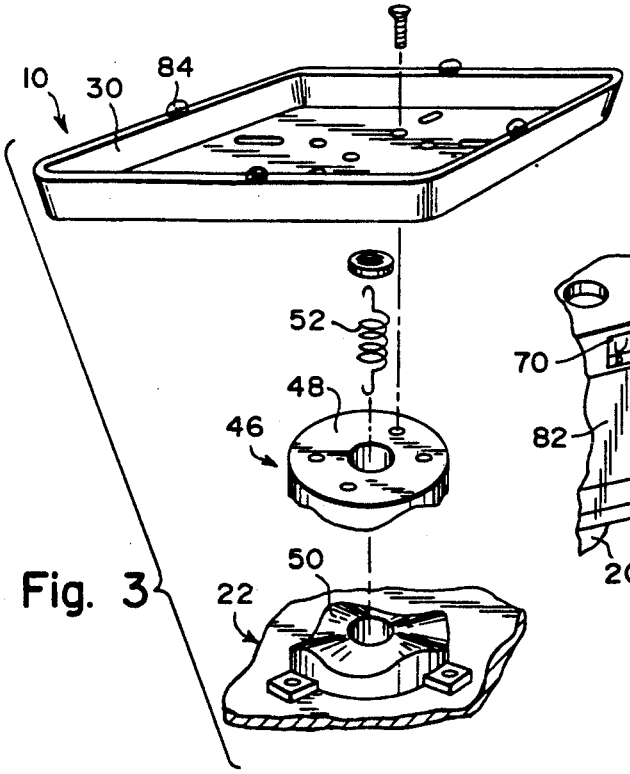
FIG. 3 is an exploded fragmentary perspective view of the rest plate swivel cam mechanism.
Figure 4:
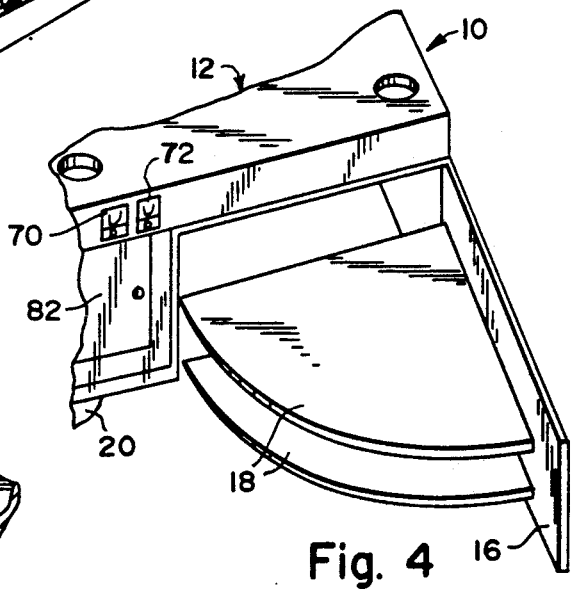
FIG. 4 is a fragmentary perspective view of the lower cabinet of the invention showing the storage door open.

The telephone table 10 further includes, as best shown in FIGS. 2 and 3, a plurality of clamps 36, that are each adjustably mounted through a slot 38 in the rest plate 30 via a bolt 40, block 42 and nut 44, so that different types of telephone bases 32 can be secured to the rest plate 30. A cam assembly 46 has an upper cam member 48 mounted to the underside of the rest plate 30. A lower cam member 50 is mounted to the upper table top 22 which is spring biased by a spring 52 to the upper cam member 40. The rest plate 30 can be swiveled and retained to the upper table top 22 in one of a multiple of positions.

Figure 1:
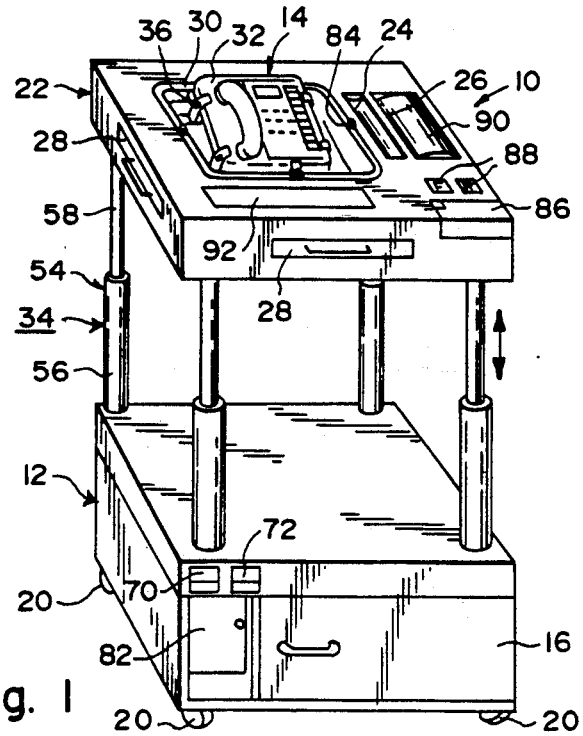
FIG. 1 is a perspective view of the instant invention.

The height varying and tilting mechanism 34, as best seen in FIGS. 1 and 5, includes four adjustable legs 54, each positioned in one corner between the lower cabinet 12 and the upper table top 22. Each leg 54 has a stationary member 56 mounted to the top of the lower cabinet 12 and a movable member 58 pivotally mounted at ball joint 60 to the bottom of the upper table top 22. The movable member 58 has an internally threaded bore 61 and slideably fits into the stationary member 56 with guides 62. Four threaded shafts 64 are provided with each threadably engagable within one of the movable members 58. Four stepping motors 66 are also provided with each mounted within the lower cabinet 12 and connected to one of the threaded shafts 64. A control box 68 is mounted within the lower cabinet 12 and is electrically connected to the four stepping motors 66. A first switch button 70 is on the lower cabinet 12 and is electrically connected to the control box 68 for operating the two front stepping motors 66 to raise and lower the two front adjustable legs 54. A second switch button 72 is one the lower cabinet 12 and is electrically connected to control box 68 for operating the two rear stepping motors 66 to raise and lower the two rear adjustable legs 54. This arrangement permits the upper table top 22, to be tipped a limited amount while at the same time being raised or lowered.

A modified telephone table **10*a* is shown in FIGS. 6 and 7, wherein the height varying and tilting mechanism 34 includes a vertical hydraulic lift cylinder 74 mounted in the center of the lower cabinet 12 and extends upwardly therefrom. A rolling ball joint 76 is mounted on the distal end of the hydraulic lift cylinder 74 which engages with the underside of the upper table top 22. Four hydraulic power cylinders 78 are positioned on top of the lower cabinet 12 about the upper portion of the hydraulic lift cylinder 74. A power unit 80 is fluidly connected to the hydraulic lift cylinder 74 and the four hydraulic power cylinders 78 so as to raise, lower and tilt the upper table top 22**.

The telephone table 10 shown in FIGS. 1 through 5, can also include an access door 82 in the lower cabinet 12 for repairing the unit power control therein. Knobs 84 can be placed upon the rest plate 30 to help turn and position it in the upper table top 22. A paper feeding machine 86 having forward and return button switches 88 can be built into the upper table top 22 to turn a note paper roll 90 within the receptacle 26. A night light 92 can also be built into the upper table top 22.

The modified telephone table 10*a* shown in FIGS. 6 and 7 can also include four coil springs 96 at each corner of the rest plate 30 to act as shock absorbers. The upper table top 22 has a hollow shaft 98 with a flange 100 extending downwardly therefrom to fit over the rolling ball joint 76. The power unit 80 contains an oil pump 102, motor 104 and controller valves 106 to supply oil into the hydraulic system.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A telephone table which comprises:

a) a lower cabinet for holding various components therein, having a storage door hinged thereto and a plurality of internal shelves attached therein, which are used in conjunction with a telephone;

b) a plurality of locking casters mounted to the underside of said lower cabinet, so that said lower cabinet can be rolled along a floor and retained in a stationary position;

c) an upper table top having receptacles for holding a pen, a pencil and note paper;

d) a pull out side board slidably mounted in said upper table top for holding writing a paper and the like;

e) a rest plate carried on said upper table top, whereby said rest plate has means for securing the base of the telephone thereto, so that a person using the telephone can not inadvertently topple over the telephone;

f) means for varying the height and tilting of said upper table top with respect to said lower cabinet, so that the person can stand, sit and recline proximate said telephone table when using the telephone;

g) a plurality of clamps adjustably mounted to said rest plate so that different types of telephone bases can be secured to said rest plate; and h) a cam assembly having an upper can member mounted to the underside of said rest plate and a lower cam member mounted to said upper table top which is spring biased to the upper cam member so that said rest plate can be swiveled and retained to said upper table top in one of a multiple of positions.

2. A telephone table as recited in claim 1, wherein said height varying and tilting means includes:

a) four adjustable legs, each positioned in one corner between said lower cabinet and said upper table top and having a stationary member mounted to the top of said lower cabinet and a movable member pivotally mounted to the bottom of said upper table top, the movable member having an internally threaded bore and slideably fits into the stationary member;

b) four threaded shafts, each threadably engageable within one of the movable members;

c) four stepping motors, each mounted within said lower cabinet and connected to one of said threaded shafts;

d) a control box mounted within said lower cabinet and electrically connected to said four stepping motors;

e) a first switch button on said lower cabinet electrically connected to said control box for operating said two front stepping motors to raise and lower said two front adjustable legs; and f) a second switch button on said lower cabinet electrically connected to said control box for operating said two rear stepping motors to raise and lower said two rear adjustable legs.

3. A telephone table which comprises:

a) a lower cabinet for holding various components therein, having a storage door hinged thereto and a plurality of internal shelves attached therein, which are used in conjunction with a telephone;

b) a plurality of locking casters mounted to the underside of said lower cabinet, so that said lower cabinet can be rolled along a floor and retained in a stationary position;

c) an upper table top having receptacles for holding a pen, a pencil and note paper;

d) a pull out side board slidably mounted in said upper table top for holding writing paper and the like;

e) a rest plate carried on said upper table top, whereby said rest plate has means for securing the base of the telephone thereto, so that a person using the telephone can not inadvertently topple over the telephone;

f) means for varying the height and tilting of said upper table top with respect to said lower cabinet, so that the person can stand, sit and reclined proximate said telephone table when using the telephone, wherein said height varying and tilting means includes:

i) a vertical hydraulic lift cylinder mounted in the center of said lower cabinet and extending upwardly therefrom;

ii) a rolling ball joint mounted on the distal end of said hydraulic lift cylinder which engages with the underside of said upper table top;

iii) four hydraulic power cylinders positioned on top of said lower cabinet about the upper portion of said hydraulic lift cylinder; and iv) a power unit fluidly connected to said hydraulic lift cylinder and said four hydraulic power cylinders so as to raise, lower and tilt said upper table top.

* * * * *